United States Patent [19]

Coalier et al.

[11] Patent Number: 4,945,007

[45] Date of Patent: Jul. 31, 1990

[54] BLANK OF MATERIAL IN SHEET FORM AND PARTITION MADE THEREFROM

[75] Inventors: Guy Coalier, Noce; Jean-Claude Serre, Beaune, both of France

[73] Assignee: Embal-Systems, Paris, France

[21] Appl. No.: 321,753

[22] Filed: Mar. 9, 1989

[30] Foreign Application Priority Data

Mar. 10, 1988 [FR] France ..... 88 03125

[51] Int. Cl.[5] ..... B65D 5/48

[52] U.S. Cl. ..... 428/542.8; 229/120.26; 229/120.29

[58] Field of Search ..... 229/120.26, 120.29; 428/542.8

[56] References Cited

U.S. PATENT DOCUMENTS

| | | | |
|---|---|---|---|
| 2,785,844 | 3/1957 | Metzger | 229/120.17 |
| 3,208,659 | 9/1965 | Blasdell et al. | 229/120.17 |
| 3,327,919 | 6/1967 | Kim | 229/120.29 |
| 3,889,580 | 6/1975 | Garst | 493/30 |
| 4,030,660 | 6/1977 | Rada et al. | 229/120.26 |
| 4,144,995 | 3/1979 | Travis | 229/120.26 X |
| 4,157,156 | 6/1979 | Skaggs | 229/120.26 |
| 4,793,547 | 12/1988 | LaPoule et al. | 229/120.29 X |

FOREIGN PATENT DOCUMENTS

| | | | |
|---|---|---|---|
| 2113549 | 10/1972 | Fed. Rep. of Germany . | |
| 2140479 | 2/1973 | Fed. Rep. of Germany . | |
| 1531548 | 5/1968 | France . | |
| 2082539 | 12/1971 | France . | |
| 2447866 | 8/1980 | France | 428/542.8 |
| 2479145 | 10/1981 | France . | |

*Primary Examiner*—Henry F. Epstein

*Attorney, Agent, or Firm*—Fisher, Christen & Sabol

[57] ABSTRACT

This invention relates to a one-piece blank made of a material in sheet form for producing a partitioning intended to subdivide a recipient into a plurality of compartments, wherein the blank comprises:

two assemblies of articulated flaps which, by folding, are each capable of forming part of the compartments of the partitioning; and an intermediate panel connected to the two assemblies of flaps respectively along a line capable of being broken and along a line capable of serving as line of fold.

8 Claims, 5 Drawing Sheets

BLANK OF MATERIAL IN SHEET FORM AND PARTITION MADE THEREFROM

BACKGROUND OF THE INVENTION

The present invention relates to a blank of material in sheet form for making a partitioning intended for the compartmenting of a recipient, to a process and a device for making such partitioning, and to the partitioning obtained from such a blank.

It is known that the purpose of such partitionings, constituted by walls intersecting in two directions, generally orthogonal, is for example to separate bottles disposed in parallel in a packing.

Known partitionings are made either from a plurality of blanks of cardboard (or of like material) provided with slots and assembled to form the walls of said partitionings, or from a blank in one piece. In the first case, at least two different sorts of blanks must be provided (one sort for the longitudinal walls, another for the transverse walls), this complicating manufacture and assembly and, in particular, it is necessary to assemble said blanks together, which is long and expensive. With blanks in one piece, the drawbacks of partitionings in several pieces are avoided, but gussets must then be made in order to be able to form each partitioning by folding flaps. Examples of such one-piece blanks are given for example in U.S. Pat. Nos. 3,889,580 and 4,157,156.

The principal drawback of such one-piece partitionings resides in the gussets that must be made, as they are a source of excess thicknesses and of dimensional instability of the partitionings due to their elasticity. There is therefore loss of material and difficulty in automatically handling them in order to introduce them into packings, and this, all the more so as the number of gussets becomes considerable as soon as the number of compartments desired for the partitioning exceeds six.

SUMMARY OF THE INVENTION

It is an object of the present invention to overcome these drawbacks.

To that end, according to the invention, the one-piece blank made of a material in sheet form for producing a partitioning intended to subdivide a recipient into a plurality of compartments, is noteworthy in that it comprises:

- two assemblies of articulated flaps which, by folding, are each capable of forming part of the compartments of said partitioning; and
- an intermediate panel connected to the two assemblies of flaps respectively along a line capable of being broken and along a line capable of serving as line of fold.

In order to make such a partitioning, such a blank is firstly formed, after which one of said flap assemblies is separated from said intermediate panel, along said line capable of being broken, then said flap assemblies are shaped in order to obtain two sub-assemblies of compartments, said partitioning being obtained by mounting said sub-assemblies of compartments against said intermediate panel, on either side thereof.

The gist of the present invention resides in that, in order to produce said partitioning, a single blank is taken, which is cut into two, which may appear paradoxal. In fact, up to the present time, in the prior art, every effort was, on the contrary, made to maintain said blank whole.

Thanks to the present invention:

- since a one-piece blank is taken, the advantages inherent in this fact are enjoyed, namely those associated with the manufacture, storage, transport of said blanks, as well as the supply of an automatic shaping machine;
- since the final partitioning is obtained by mounting two sub-assemblies of compartments, each of them may comprise only a sufficiently small number of compartments, with the result that it is unnecessary to provide gussets; in this way, each of said subassemblies of compartments may be obtained by simply folding flaps;
- the intermediate panel may be used for making one of the walls of the partitioning, which simplifies production of said flap assemblies accordingly;
- the one-piece blank may also be used for making two distinct partitionings, each corresponding to one of said sub-assemblies of compartments.

In an advantageous embodiment, the blank of material in sheet form is symmetrical with respect to an axis and it comprises:

- two assemblies of identical and opposite flaps of which each comprises:
  - an area defined by four lines rectangular in two's, of which two are parallel and the other two are perpendicular to said axis of symmetry;
  - a first flap connected to said area along one of the two lines parallel to said axis of symmetry, said first flap being provided, on the side opposite this latter line, with two slots, disposed at least approximately in line with said lines perpendicular to said axis of symmetry; and
  - two second flaps, at least approximately in the form of an angle, of which one arm is connected to said area along one of said lines perpendicular to said axis of symmetry and of which the other arm is disposed laterally to said first flap;
- and an intermediate panel, connected to each of said flap assemblies (i.e., connected to each of said rectangular areas, i.e., disposed opposite to each of said two first flaps) along said corresponding line, parallel to said axis of symmetry and opposite said first flap.

In that case, in order to obtain the corresponding partitioning from said blank, one of said flap assemblies is separated from said intermediate panel along the line connecting said intermediate panel to the corresponding rectangular area of said flap then said first and second flaps and said intermediate panel are folded at 90° around said corresponding lines of said rectangular areas, introducing the free ends of the lateral arms of said second flaps in the slots of said corresponding first flap, in order to obtain two half-partitionings separated by said intermediate panel.

Said lines around which folding is effected are advantageously preformed in conventional manner. Similarly, it is preferable if at least one of the lines parallel to said axis of symmetry is pre-cut, in order to facilitate separation of one of said flap assemblies from said intermediate panel.

As will be seen hereinafter, said intermediate panel performs the role, in this embodiment, of one of the walls of said partitioning. It is advantageous if, parallel to said axis of symmetry, the dimensions of said first flaps and of said intermediate panel are at least approximately equal.

When it is desired to obtain compartments which are at least approximately similar and of square section, said area is arranged to be square, the dimensions of said first flaps parallel to the axis of symmetry are arranged to be of the order of three times the length of one side of said area, and the length of the lateral arm of said second flaps is arranged to be of the order of twice that of one side of said area.

The present invention also relates to a machine for forming a partitioning for compartmenting a recipient from the one-piece blank set forth hereinabove.

According to the invention, this machine comprises means for separating one of said flap assemblies from said intermediate panel along said line capable of being broken;

means for folding said intermediate panel with respect to said flap assembly with which it remains fast;

means for bringing the separate flap assembly closer to the other flap assembly in order to mount it on the folded intermediate panel; and means for simultaneously shaping the two flap assemblies brought closer together.

In an advantageous embodiment, said means for separating one of said flap assemblies from said intermediate panel comprise a pivoting flap and a fixed counter-flap, disposed on either side of said blank, and said pivoting flap constitutes the means for folding said intermediate panel with respect to said flap assembly with which it remains fast.

The machine preferably comprises means for moving said blank in translation and said separating and folding means act during displacement of said blank.

The means for simultaneously shaping the two flap assemblies after they have been brought closer to each other advantageously comprise a jack and ramps for folding the flaps of said blank.

The invention also relates to the partitioning obtained from the blank set forth hereinabove, or by carrying out the process or employing the machine according to the invention.

BRIEF DESCRIPTION OF THE DRAWINGS

The invention will be more readily understood on reading the following description with reference to the accompanying drawings, in which.

FIGS. *2a* to *2f* schematically illustrate the formation of said partitioning from a blank according to the present invention.

Figure 3:
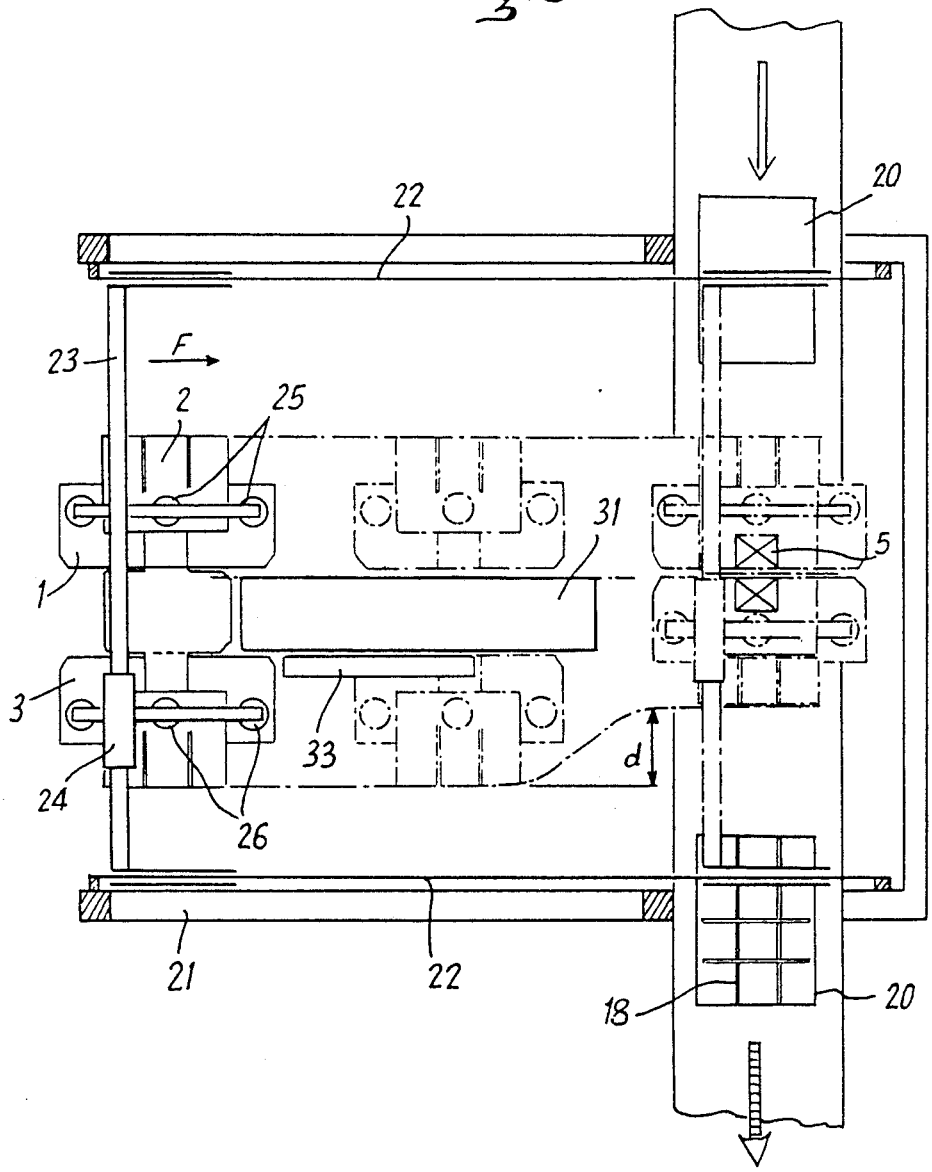

FIG. 3 is a schematic view in elevation of a machine for shaping the partitionings according to the invention and for introducing said partitionings in packings.

Figure 4:
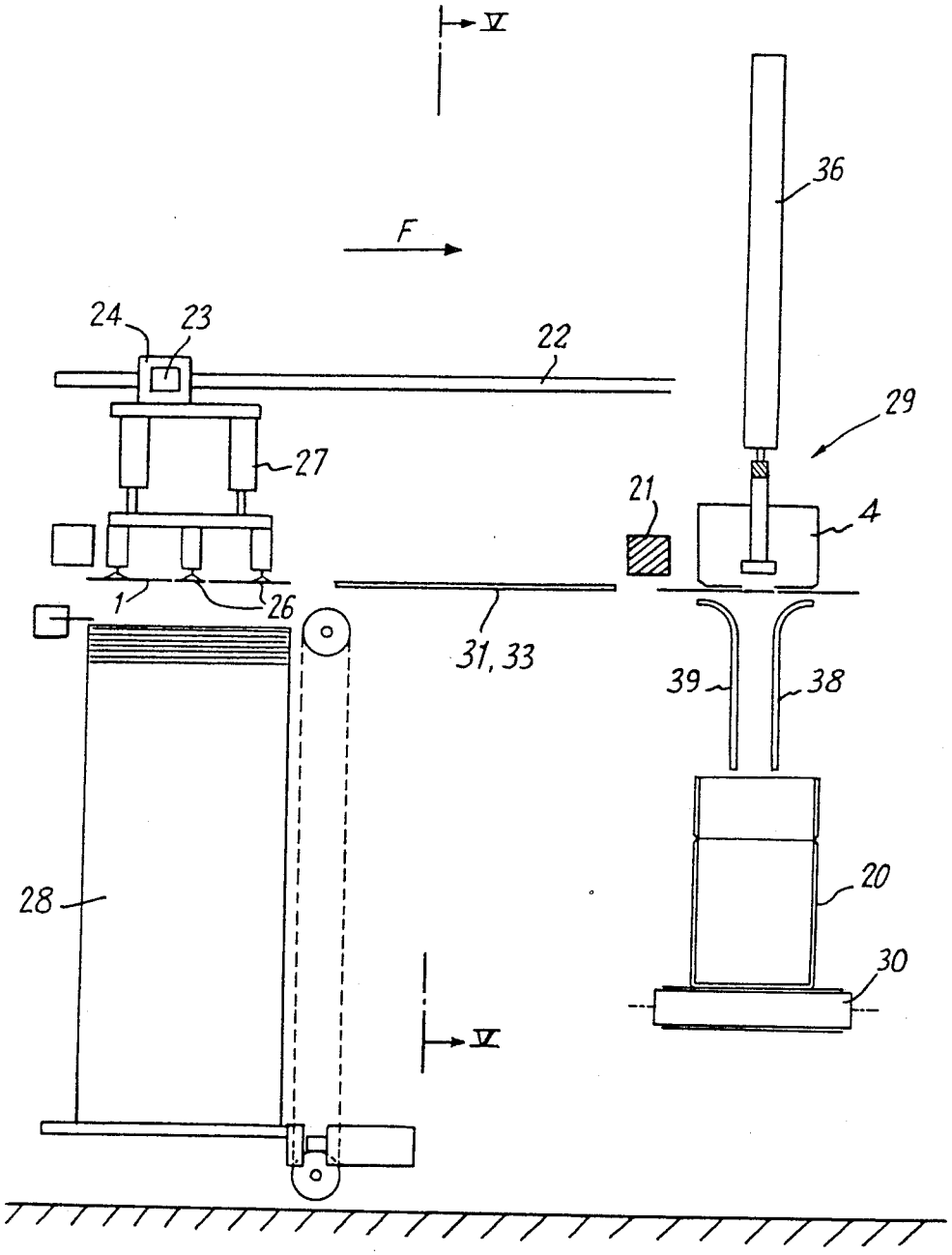

FIG. 4 is a schematic plan view of the machine of FIG. 3.

Figure 5:
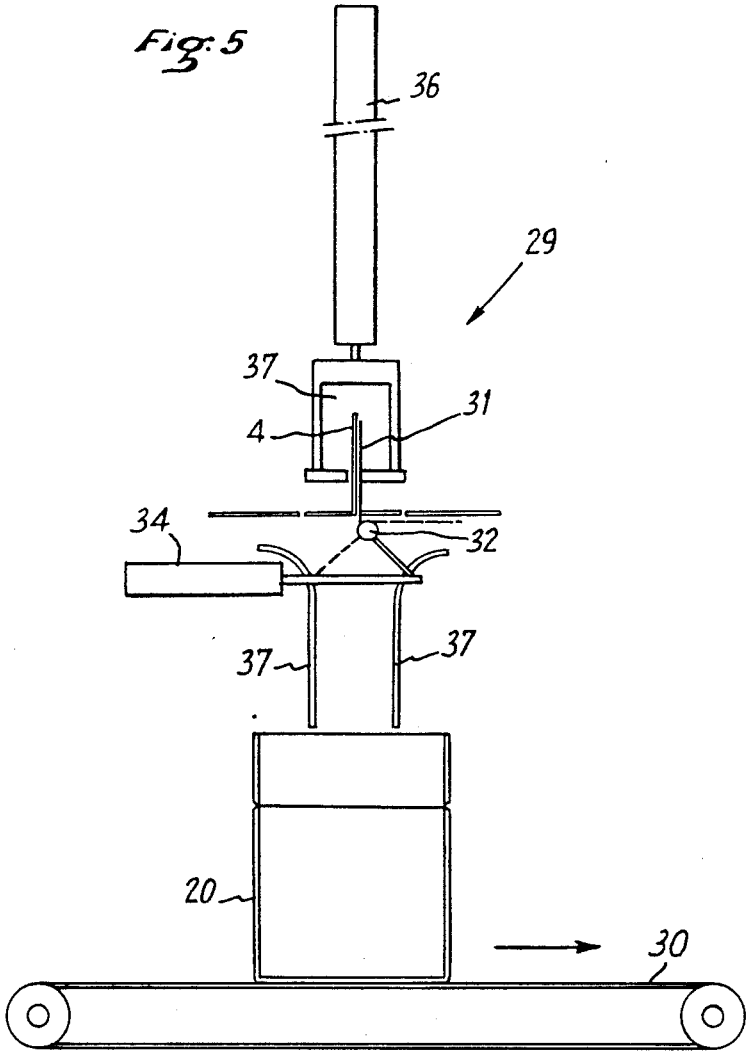

FIG. 5 is a view along line V—V of FIG. 4.

Figure 6:
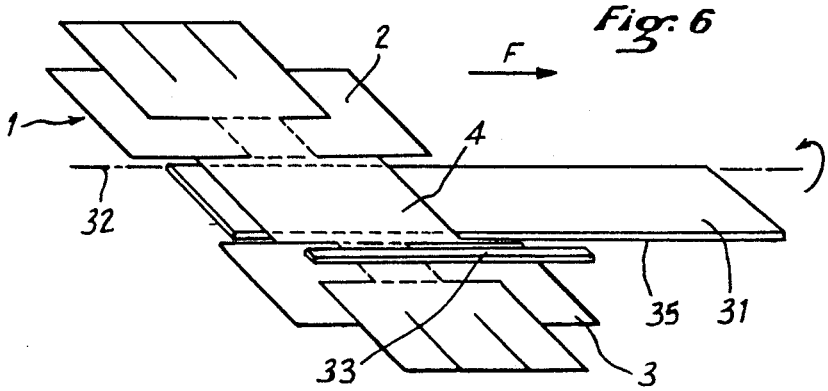

FIG. 6 illustrates the simultaneous cut-out and lifting of the intermediate panel.

DETAILED DESCRIPTION OF THE PREFERRED EMBODIMENTS

Figure 1:
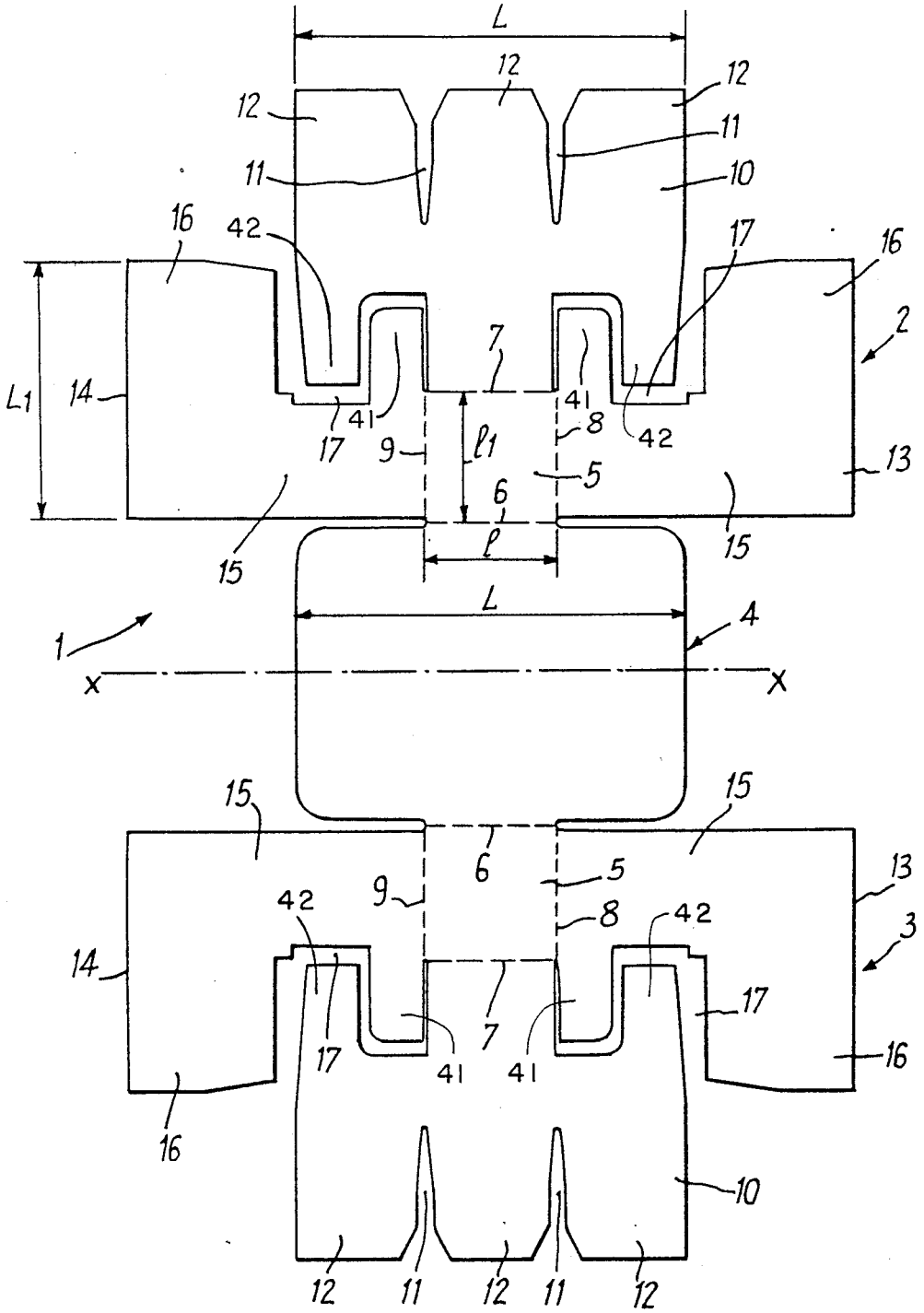
FIG. 1 is a plan view of an embodiment of a blank for making a partitioning for compartmentation according to the present invention.

Referring now to the drawings, the embodiment of the blank 1 according to the present invention and shown in FIG. 1, is cut out from a material in sheet form, such as corrugated cardboard, for example. It is intended to form a partitioning for compartmenting a recipient, for example a packing in parallelepipedic form, likewise made of corrugated cardboard. The interior of said packing may thus be divided, thanks to said partitioning, into a plurality of compartments in which an object, such as a bottle, may be introduced.

This blank 1 is at least approximately symmetrical with respect to an axis X—X. It is constituted by two identical flap assemblies 2 and 3, connected to each other by an intermediate panel 4. Axis X—X is in median position for the intermediate panel 4 and said flap assemblies 2 and 3 are opposite with respect to each other and symmetrically disposed with respect to said axis X—X.

The intermediate panel 4 is, for example, at least approximately rectangular.

Each flap assembly 2 and 3 comprises an area 5 defined by four lines 6 to 9, rectangular in two's.

Lines 6, parallel to axis X—X, connect each of the flap assemblies 2 and 3 to the intermediate panel 4. Their length $\underline{l}$ is less than the length L of the intermediate panel 4, parallel to axis X—X. For example, the length $\underline{l}$ is approximately equal to one third of length $\underline{L}$.

Lines 7, parallel to lines 6, connect each area 5 to first flaps 10 of which the dimensions, parallel to axis X—X, are equal to the length $\underline{L}$ of the intermediate panel. On the side opposite the corresponding line 7, each first flap 10 comprises two slots 11, perpendicular to axis X—X, which divide said flap into three bands 12 of substantially equal widths. The bands 12 are fast with one another by the rest of the flap 10, towards area 5. In this way, the length $\underline{l}$ of the lines 7 is approximately equal to the width of said bands 12 and each line 7 is located at the base of the median band 12 of each flap 10.

Lines 8 and 9 of each flap assembly 2 and 3, which are parallel to each other and perpendicular to axis X—X, join the corresponding area 5 to two second flaps 13 and 14, respectively. Each of the second flaps 13 and 14 is at least approximately in the form of an angle, with a first arm 15, parallel to axis X—X and connected to the corresponding area 5 by line 8 or 9, and a second arm 16, perpendicular to axis X—X and disposed laterally with respect to the corresponding first flap 10. A line of cut 17 separates said second flaps 13 and 14 from said first flap 10 associated therewith. Preferably, said line of cut 17 between said first arm 15 of said second flaps 13 and 14 and said outer bands 12 of said first flaps 10 is cut so as to form a tongue 41 on, and at the base of, (from the perspective of once said flaps 13 and 14 are folded up vertically) of said first arm 15, and to form a tongue 42 on the outer bands 12 of said first flaps 10.

The length L1 of arm 16 of each of said second flaps 13 and 14 is approximately double the distance $\underline{l}$ separating the lines 6 and 7 of each area 5. This distance $\underline{l}$ is advantageously equal to the length $\underline{l}$ of the areas 5 parallel to axis X—X, with the result that each area 5 is square.

In order to form a partitioning for compartmentation from the blank 1 shown in FIG. 1, operation is schematically illustrated in FIGS. *2a* to *2f*.

Blank 1 (cf. schematic FIG. *2a* in perspective) undergoes a first operation which consists in separating one of the flap assemblies 2 or 3, by cutting along the corresponding line 6. For example, in FIG. *2b*, it has been assumed that the flap assembly 3 was separated from the rest of the blank 1, which is then constituted by the flap assembly 2 and the intermediate panel 4. This intermediate panel 4 may then be folded, around line 6 connecting it to the flap assembly 2, so that its plane is at right angles to that of said flap assembly 2 (cf. FIG. 2*c*). After such folding of the intermediate panel 4, flap assembly 3 may be brought closer to flap assembly 2, so that said flap assemblies 2 and 3 are adjacent and opposite (cf. FIG. 2*d*).

Figure 2A:
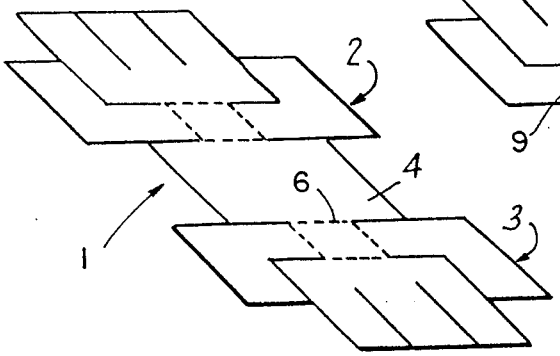

In the close position of the flaps thus obtained, for each flap assembly 2 and 3, the first flaps 10 are then folded around the corresponding line 7 and the second flaps 13 and 14 around corresponding lines 8 and 9 (cf. FIG. 2*e*) and the free ends of the second arms 16 of the second flaps 13, 14 are introduced into the slots 11 of the corresponding first flap 10.

Figure 2B:
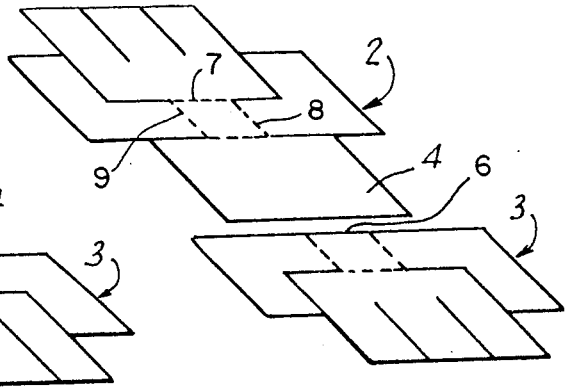
Figure 2C:
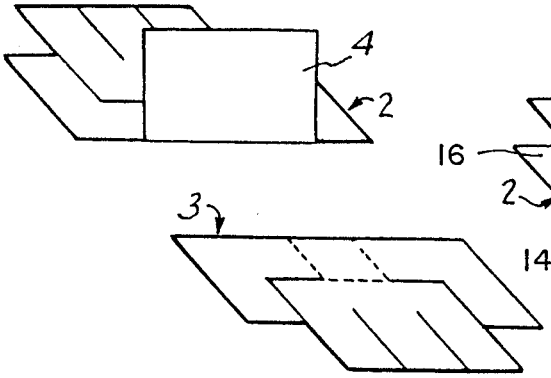
Figure 2D:
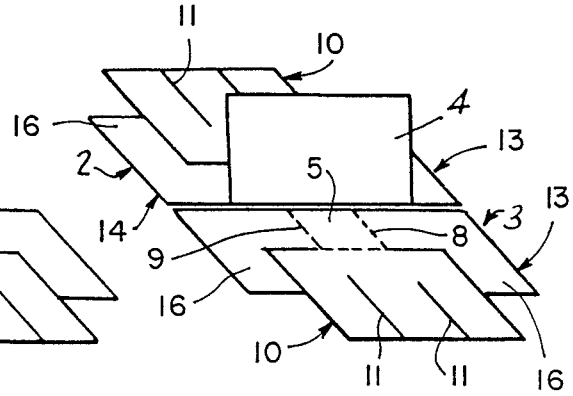
Figure 2E:
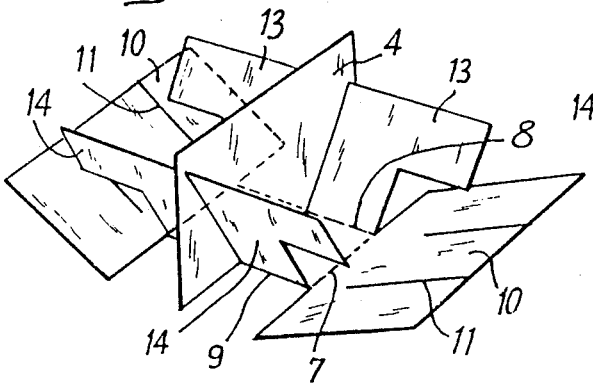
Figure 2F:
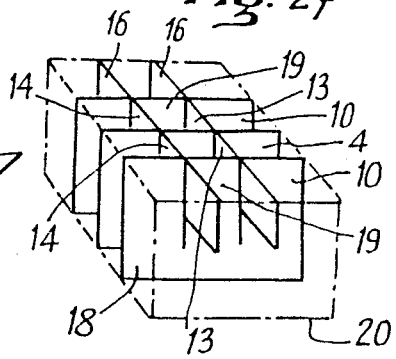

When flaps 10, 13 and 14 have been folded so that their plane is at right angles to that of the corresponding area 5, the compartmentation partitioning 18, with twelve compartments 19, is obtained as schematically shown in FIG. 2*f*. The partitioning 18 may then be introduced into a packing or recipient 100, simply indicated by chain-dotted lines in FIG. 2*f*.

The machine according to the invention and shown in FIGS. 3, 4 and 5, comprises a frame 21, shown very succinctly, comprising two horizontal rails 22. A transverse beam 23 is mounted to slide on the rails 22 (known per se and not shown), in order to be able to move in translation parallel to itself. A carriage 24 slides on the transverse beam 23. Gripping means 25 and 26 (suction cups) are respectively borne by said beam 23 and by said carriage 24. These gripping means 25 and 26 may be raised and lowered by means of jacks 27.

In this way, the blanks 1 may be displaced in translation between a storage magazine 28 and a station 29 for forming the partitionings and for introducing them into cardboard boxes 20, circulating on a conveyor 30.

Plumb with the storage magazine 28, the gripping means 25 and 26 are lowered in order to take a blank 1 from said magazine, gripping means 25 supporting flap assembly 2 and gripping means 26 supporting flap assembly 3. After removal, blank 1 is raised, then displaced towards station 29 (cf. arrow F).

On the path of the blank 1 is disposed a pivoting flap 31, capable of rotating about an axis 32, parallel to displacement F, as well as a fixed counter-flap 33. Pivoting flap 31 is actuated by a mechanism 34 in order to be able to pivot from a horizontal position to a vertical position, and vice versa (cf. FIG. 6).

During its passage, the blank 1 slides on the pivoting flap 31, but passes beneath the counter-flap flap 33. Furthermore, the free edge 35 of the flap 31 and that of the counter-flap 33 are in the vicinity of the line of connection 6 between the intermediate panel 4 and the flap assembly 3, on either side of this line. In this way, when the mechanism 34 is actuated, the flap 31 pivots and the intermediate panel 4 is sheared along said line 6, thanks to the cooperation of flap 31 and of counter-flap 33. In that case, the operations respectively illustrated in FIGS. 2*b* and 2*c* are carried out simultaneously. In addition, they are carried out during the advance of the blank 1 towards station 29.

Thanks to carriage 24, after separation of the flap 3 and lifting of the intermediate panel 4, the gripping means 26 may be brought closer to the gripping means 25 by distance d, so that blank 1 is then brought into the configuration of FIG. 2*d*.

At station 29, a jack 36, whose head 37 is shaped in order to abut on the two areas 5 of a blank 1 whilst allowing the raised intermediate panel 4 to pass, is capable of pushing said blank 1 (in the configuration of FIG. 2*d*) against stop rails 37, 38 and 39, respectively intended to fold flaps 10, 13 and 14. These flaps are then folded as indicated in FIG. 2*a*, so that the arms 16 automatically penetrate into slots 11 and the partitioning 18 is obtained which is introduced by jack 36 through rails 37, 38 and 39 into a box 20 located on the conveyor 30 plumb with said jack 36. The box 20, provided with its partitioning 18, may then be evacuated.

What is claimed is:

1. A one-piece blank made of a material in sheet form for producing a partitioning intended to subdivide a recipient container into a plurality of compartments, wherein said blank comprises:

two assemblies of articulated flaps which, by folding, are each capable of forming part of the compartments of said, partitioning; and an approximately rectangular intermediate panel connected to the two assemblies of flaps respectively along a line capable of being broken and along a line capable of serving as line of fold.

2. The blank of claim 1, symmetrical with respect to an axis, wherein said blank comprises:

two assemblies of identical and opposite flaps of which each comprises:

an area defined by four lines rectangular in two's, of which two are parallel and the other two are perpendicular to said axis of symmetry;

a first flap connected to said area along one of the two lines parallel to said axis of symmetry, said first flap being provided, on the side opposite this latter line, with two slots, disposed at least approximately in line with said lines perpendicular to said axis of symmetry; and two second flaps, at least approximately in the form of an angle, of which one arm is connected to said area along one of said lines perpendicular to said axis of symmetry and of which the other arm is disposed laterally to said first flap;

and an intermediate panel, connected to each of said flap assemblies along said corresponding line, parallel to said axis of symmetry and opposite said first flap.

3. The blank of claim 2, wherein at least one of the lines parallel to said axis of symmetry is pre-cut.

4. The blank of claim 2, wherein, parallel to said axis of symmetry, the dimensions of said first flaps and of said intermediate panel are at least approximately equal.

5. The blank of claim 2, wherein said area is square, and the dimensions of said first flaps parallel to the axis of symmetry is of the order of three times the length of one side of said area, whilst the length of the lateral arm of said second flaps is of the order of twice that of one side of said area.

6. A partitioning for compartmenting a recipient container, wherein said partitioning is obtained from the blank of claim 1.

7. A one-piece blank of sheet material for producing a partitioning intended to subdivide a recipient container into a plurality of compartments, comprising:

(a) a rectangular intermediate panel, said intermediate panel having a central longitudinal axis;

(b) a pair of substantially identical assemblies of flaps, said flap assemblies being attached to opposite of the longer sides of said rectangular intermediate panel, each of said flap assemblies including:

(1) a central rectangular area connected to said intermediate rectangular panel, said rectangular area being defined by four fold lines, a first of said fold lines being the connection between said central rectangular area and said intermediate rectangular panel;

(b 2) a first flap connected to said second fold line, said second fold line being parallel to said longitudinal axis of said rectangular intermediate panel and disposed on the side of said central rectangular area opposite from said first fold line; said first flap further including a pair of slots disposed perpendicular to said longitudinal axis of said intermediate panel, said slots running from the edge of said first flap disposed opposite to said intermediate panel and running part way through said first flap, said slots being disposed substantially equidistant from each other and from the edges of said first flap which are perpendicular to said longitudinal axis of said rectangular intermediate panel, whereby said first flap comprises three substantially equal bands; and, (3) a pair of second flaps, said second flaps disposed opposite each other and connected to said third and fourth fold lines, wherein each of said second flaps includes a first arm connected to said third or fourth fold line, the longitudinal axis of said first arm being parallel to said longitudinal axis of said rectangular intermediate panel and a second arm, the longitudinal axis of said second arm of said second flap being perpendicular to said longitudinal axis of said rectangular intermediate panel; and, (c) each of said second flaps being separated from said first flap by a line of cut, said line of cut defining a first tongue of said sheet material disposed on said first arm of said second flap adjacent to said third or fourth fold line, and a second tongue disposed on the outer side of said outer band of said first flap.

8. The one-piece blank of claim 7, wherein one of said connections between said rectangular intermediate panel and said pair of flap assemblies is a fold line and one of said connections is frangible.

* * * * *